US012227954B2

(12) United States Patent
Bae

(10) Patent No.: US 12,227,954 B2
(45) Date of Patent: Feb. 18, 2025

(54) STACK ASSEMBLY-TYPE APPARATUS FOR SUPPORTING FORMWORK

(71) Applicant: Sang Hun Bae, Gimpo-si (KR)

(72) Inventor: Sang Hun Bae, Gimpo-si (KR)

( * ) Notice: Subject to any disclaimer, the term of this patent is extended or adjusted under 35 U.S.C. 154(b) by 113 days.

(21) Appl. No.: 17/253,733

(22) PCT Filed: Nov. 30, 2018

(86) PCT No.: PCT/KR2018/015056

§ 371 (c)(1),
(2) Date: Dec. 18, 2020

(87) PCT Pub. No.: WO2020/004737

PCT Pub. Date: Jan. 2, 2020

(65) Prior Publication Data

US 2024/0263465 A1 Aug. 8, 2024

(30) Foreign Application Priority Data

Jun. 29, 2018 (KR) ..... 10-2018-0075221

(51) Int. Cl.

| | |
|---|---|
| ***E04G 17/14*** | (2006.01) |
| ***E04G 11/08*** | (2006.01) |
| ***E04G 17/04*** | (2006.01) |
| ***E04G 25/00*** | (2006.01) |

(52) U.S. Cl.

CPC ..... *E04G 17/14* (2013.01); *E04G 11/08* (2013.01); *E04G 17/04* (2013.01); *E04G 25/00* (2013.01)

(58) Field of Classification Search

CPC ..... E04G 17/14; E04G 11/08; E04G 25/00
See application file for complete search history.

(56) References Cited

U.S. PATENT DOCUMENTS 3,819,143 A * 6/1974 Butts ..... E04C 3/07 249/189
4,127,254 A * 11/1978 Kahan ..... E04G 17/14 249/27

(Continued)

FOREIGN PATENT DOCUMENTS

| | | |
|---|---|---|
| JP | 2617737 | 6/1997 |
| JP | 3070599 | 8/2000 |

(Continued)

*Primary Examiner* — Omar F Hijaz
(74) *Attorney, Agent, or Firm* — LEX IP MEISTER, PLLC

(57) ABSTRACT

A formwork supporting apparatus for supporting a formwork for casting concrete is proposed. More specifically, a formwork supporting apparatus is installed by paratactically connecting at least one support frame (100) achieved by connecting a front and a rear vertical frame (10, 20) in a square form by a connection frame (30), so as to support a formwork, wherein the support frame (100) is connected and assembled by a front and a rear vertical assembling part (60, 70) while being vertically stacked corresponding to the height of the formwork. Therefore, during casting and curing of concrete while continuing to connect and install the formwork upward, the supporting apparatus is installed by connecting the support frame to be consecutively stacked upward instead of reinstalling a support frame on the upper position as in the prior art, and thus can significantly improve workability and convenience.

5 Claims, 9 Drawing Sheets

(56) References Cited

U.S. PATENT DOCUMENTS

| | | | | |
|---|---|---|---|---|
| 5,843,327 | A * | 12/1998 | Lindgren | E04G 17/042 249/219.1 |
| 2006/0260239 | A1* | 11/2006 | Boese | E04G 17/14 52/426 |
| 2009/0146043 | A1* | 6/2009 | Gates | E04G 13/00 249/126 |

FOREIGN PATENT DOCUMENTS

| | | |
|---|---|---|
| KR | 20-0134532 | 2/1999 |
| KR | 20-0439843 | 5/2008 |
| KR | 200439843 Y1 * | 5/2008 |
| KR | 10-1439101 | 9/2014 |
| KR | 101439099 B1 * | 9/2014 |

* cited by examiner

STACK ASSEMBLY-TYPE APPARATUS FOR SUPPORTING FORMWORK

TECHNICAL FIELD

The present disclosure relates to a formwork supporting apparatus for supporting a formwork used when pouring concrete. More particularly, the present disclosure relates to a stack-assembly-type apparatus for supporting a formwork, wherein a plurality of square support frames is installed in parallel in left and right directions to support a formwork, and the square support frames are installed to be continuously stacked upward to support the formwork, instead of a conventional method of re-installing a support frame at an upper location corresponding to the height of the formwork.

BACKGROUND ART

In general, a structure such as a concrete wall is completed by placing reinforcing bars inside the structure and pouring and curing concrete.

In the process, after concrete is poured, the formwork is installed temporarily to restrain the concrete. At this time, a formwork supporting apparatus is used to fix and support the formwork.

The above-described conventional formwork supporting apparatus has a support frame of a triangular structure by including a vertical support supporting an outside surface of the formwork, a horizontal support, and an inclination support connecting the vertical support to the horizontal support. A plurality of conventional formwork supporting apparatus is installed in left and right directions along a rear surface of the formwork to support the formwork.

In particular, when concrete pouring and curing work is repeatedly performed while the plurality of formworks is continuously connected upward to each other corresponding to the floor height of a concrete structure or a multi-layer structure, the concrete pouring and curing work is performed at a lower formwork and the formwork supporting apparatus is separated from the formwork, and after a work structure is installed, the formwork supporting apparatus is re-installed on an upper portion of the work structure to support an upper formwork, and the process of pouring and curing concrete is repeated.

In the conventional case, in response to the installation height of the formwork, the supporting apparatus supporting the formwork is separated, and the supporting apparatus is re-installed to support the formwork at the separated location. Accordingly, workability and convenience when using a formwork supporting apparatus are significantly deteriorated.

In addition, the conventional formwork supporting apparatus does not have a separate step capable of allowing an operator to safely move on the upper portion of the apparatus, it is inconvenient when the operator performs moving work, and a safety accident occurs during working.

DISCLOSURE

Technical Problem

Accordingly, the present disclosure has been made keeping in mind the above problems occurring in the related art, and the present disclosure is intended to significantly improve workability and convenience when using a formwork supporting apparatus. In the formwork supporting apparatus, a plurality of square support frames is installed in parallel in left and right directions to support the formwork, and is continuously stacked upward to support the formwork, instead of a conventional method of reinstalling a support frame at an upper location corresponding to the height of the formwork.

Another objective of the present disclosure is to provide excellent workability and convenience when using a formwork supporting apparatus, wherein square support frames are stacked upward and easily and firmly installed.

A further objective of the present disclosure is to provide excellent workability and convenience when using a formwork supporting apparatus, wherein a step is easily installed on an upper portion of a support frame so that an operator can move and work safely.

Technical Solution

According to the present disclosure achieving the above objective, there is provided a stack-assembly-type apparatus for supporting a formwork. The stack-assembly-type supporting apparatus includes: a support frame including a front vertical frame positioned at a rear surface of a formwork, a rear vertical frame positioned at rear of the front vertical frame, and a connection frame connecting the front vertical frame to the rear vertical frame in a square form; front and rear pipe fixing parts configured to couple and assemble at least one support frame provided in parallel in left and right directions to front and rear connection pipes provided in left and right directions at front and rear portions of the support frame; and front and rear vertical assembling parts configured to connect and assemble the support frame to another support frame by vertically stacking the support frames. The apparatus is characterized in that the support frame may be continuously stacked upward to support.

In the front vertical assembling part, a connection part may be located on an upper portion of the front vertical frame and extend upward higher than an upper end of the rear vertical frame, and left and right brackets configured to be connected to a lower connection frame in the left and right directions may extend. The front vertical assembling part may be configured such that the connection part located at the upper portion of the front vertical frame may be inserted into an insertion groove located between left and right brackets in the lower portion of another front vertical frame, so that vertical assembly of the front vertical frame may be achieved, and the rear vertical assembling part may be configured such that an insertion protrusion formed by protruding from an upper portion of the rear vertical frame may be inserted into an inner insertion hole located at a lower portion of another rear vertical frame, so that vertical assembly of the rear vertical frame may be achieved.

The left and right brackets of the front vertical assembling part may be configured to be inclined and connected to each other by both the lower connection frame and an inclination part, an assembly part including an inclination surface corresponding to the inclination part of each of the left and right brackets and a coupling hole located perpendicularly to the inclination surface may be securely provided on the upper portion of the front vertical frame and may be inserted between the left and right brackets, and a fastening screw rod that may be supported such that an upper end thereof may be blocked to upper ends of the left and right brackets by a support washer may be screw-coupled to the coupling hole, so that the front vertical assembling part may be vertically fixed.

The front pipe fixing part may have a pipe insertion groove at a position between the upper portion of the front vertical frame and an upper connection frame, and the front connection pipe may be inserted into the pipe insertion groove, the pipe insertion groove being configured such that a fore end of a clamping bolt that may be screw-coupled to a screw hole of a first fixing means in the rear of the pipe insertion groove may fix the front connection pipe by applying pressure thereto, and the rear pipe fixing part may be configured such that, a second fixing means in which a pipe insertion groove may be formed to be open upward may be securely provided on a rear surface of an upper portion of the rear vertical frame, and the rear connection pipe may be inserted into the pipe insertion groove, and a fore end of the clamping bolt that may be screw-coupled to a screw hole located at the rear of the pipe insertion groove may fix the rear connection pipe by applying pressure thereto.

First and second moving rollers may be provided in a front portion and a rear portion of a lower portion of the support frame, wherein the first moving roller may have a cylindrical shape to roll forward and rearward and the second moving roller may have a ball shape to roll in all direction.

The rear vertical frame may include a height adjustment means, a height adjustment bar, and a support means, wherein the height adjustment means may have a screw hole and be securely provided on a rear surface of the lower portion of the rear vertical frame, the height adjustment bar in which a lower support plate may be connected to a lower portion thereof may be vertically screw-coupled to the screw hole by being inserted from a lower portion of the screw hole, and the support means may have an upper support surface and may be securely provided on a rear surface of an upper portion of the rear vertical frame to support seating of the height adjustment bar.

A step on which an operator moves may be provided at upper portions of the front and rear connection pipes, the step may include: a front support means having a semi-circular insertion groove and being provided in a lower portion of a front portion of the step so that the front connection pipe may be inserted into the semi-circular insertion groove; and a rear support means provided in a rear portion of the step and having both an inclination surface configured to guide insertion of the rear connection pipe and a vertical surface configured to support the rear connection pipe to be prevented from separation.

Advantageous Effects

According to the present disclosure, at least one support frame, which is formed by connecting the front vertical frame to the rear vertical frame in a square form by the connection frame, is installed in parallel by the front and rear connection pipes to support the formwork. Corresponding to the height of the formwork, as the lower portions of the front and rear vertical frames of the support frames are stacked upward on the upper portions thereof, and the upper and lower portions of the front and rear vertical frames are connected to each other by the front and rear vertical assembling parts. When the formworks are continuously installed and then concrete pouring and curing work is repeatedly performed, the square support frames are installed to support the formwork while being continuously stacked upward, instead of a conventional method of re-installing the support frame at an upper location, so workability and convenience when using a formwork supporting apparatus can be significantly improved.

In addition, the support frames of the present disclosure are easily and firmly installed by being connected upward to each other, and the step on which the operator can move is simply installed on the upper portion of the support frame, so that excellent workability and safety of the operator can be provided. Furthermore, the installation of the support frame can be easily performed while moving the support frame by using the moving roller, so that improved convenience in use can be provided.

BEST MODE

Figure 1:
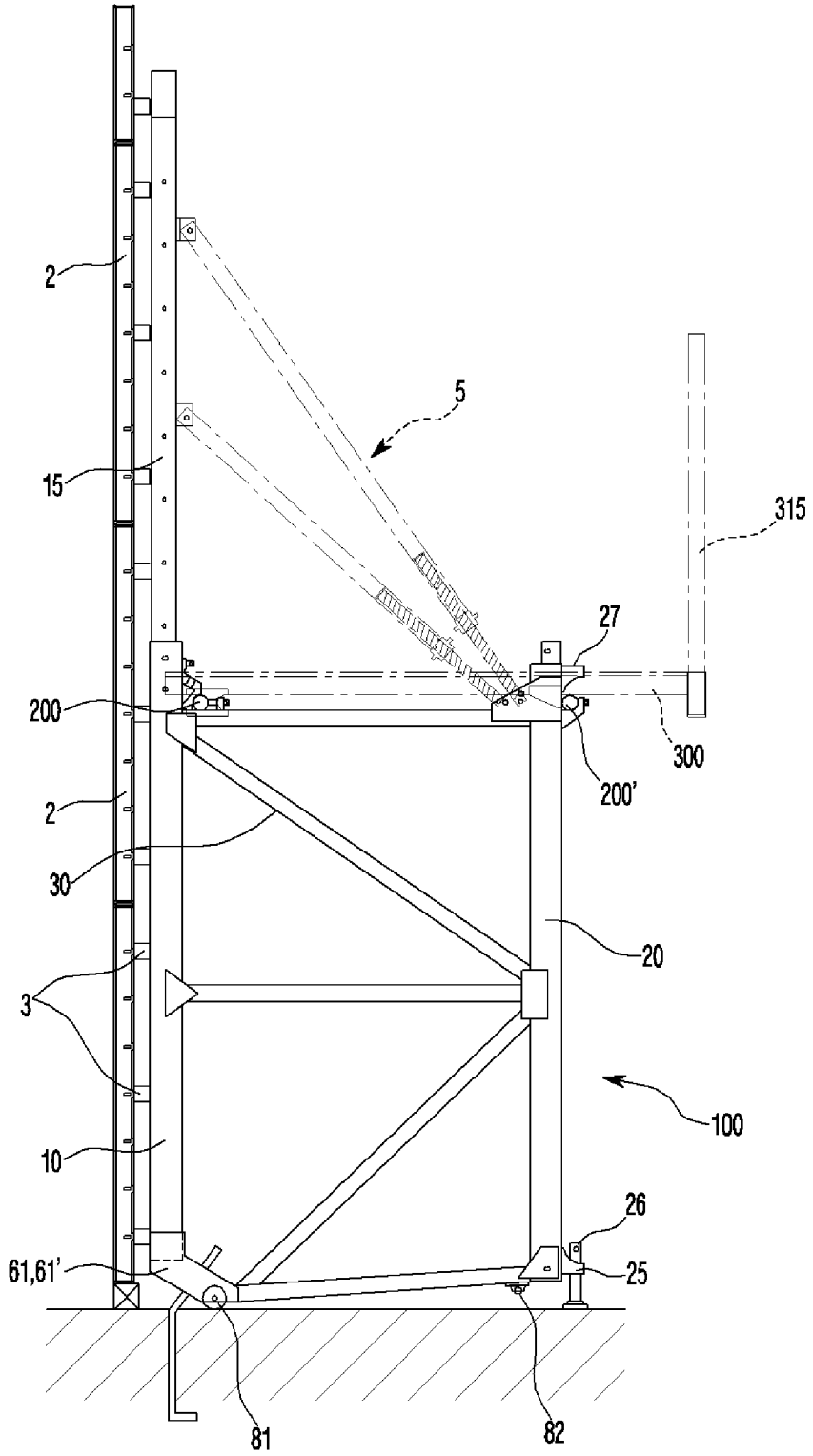
FIG. 1 is a side view showing a single-layer installation status of an apparatus according to the present disclosure.
Figure 2:
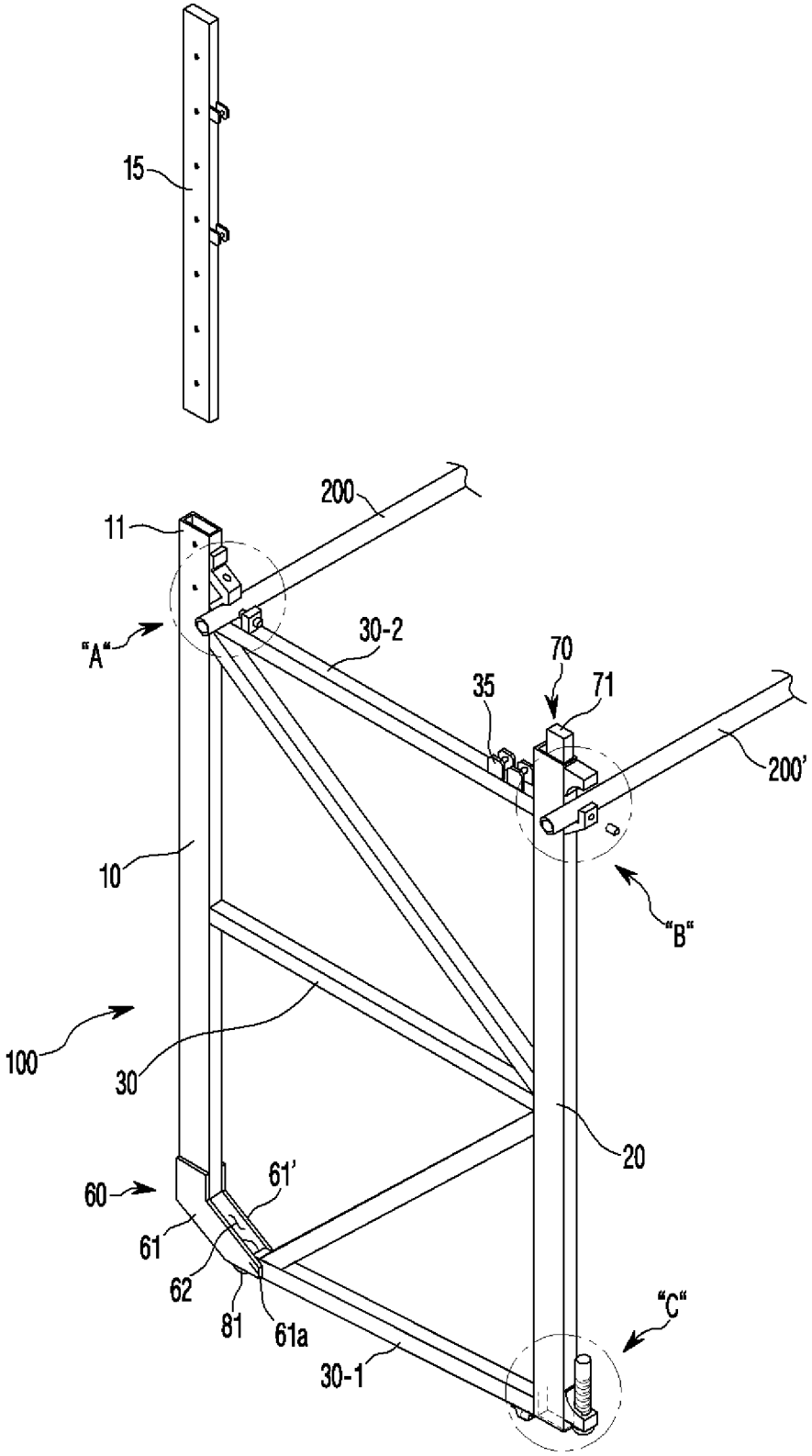
FIG. 2 is a perspective view showing a main part of the apparatus according to the present disclosure.
Figure 3:
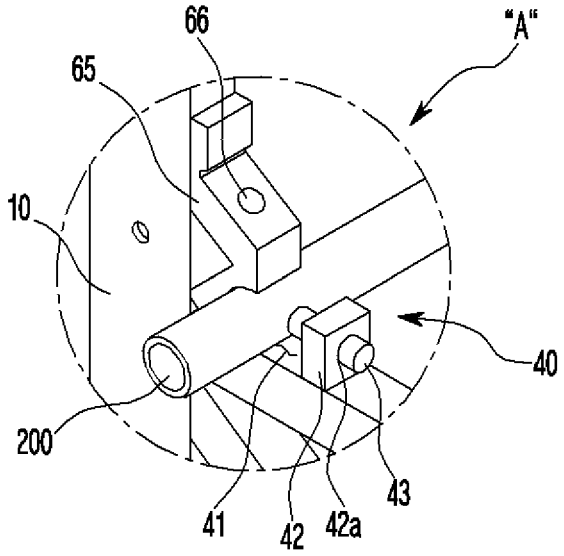
FIGS. 3 to 5 are partially enlarged views of parts "A", "B", and "C" in FIG. 2.
Figure 4:
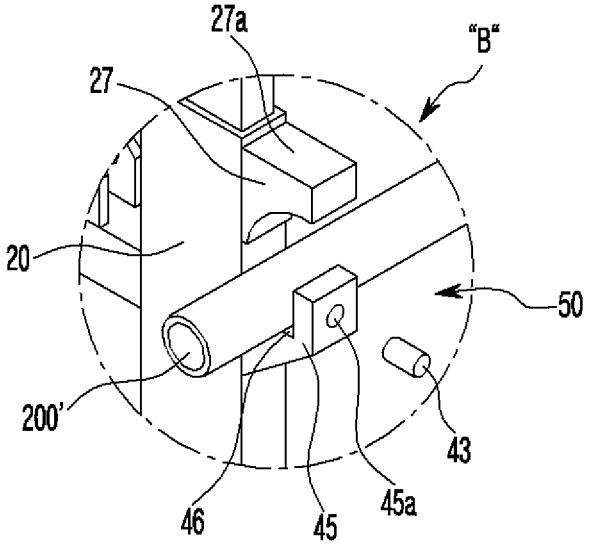
Figure 5:
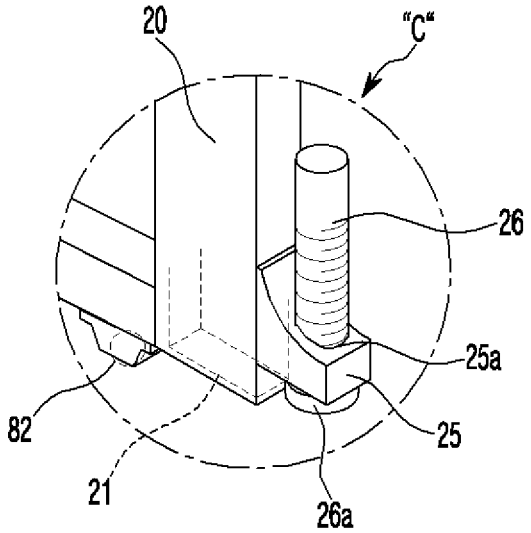
Figure 6:
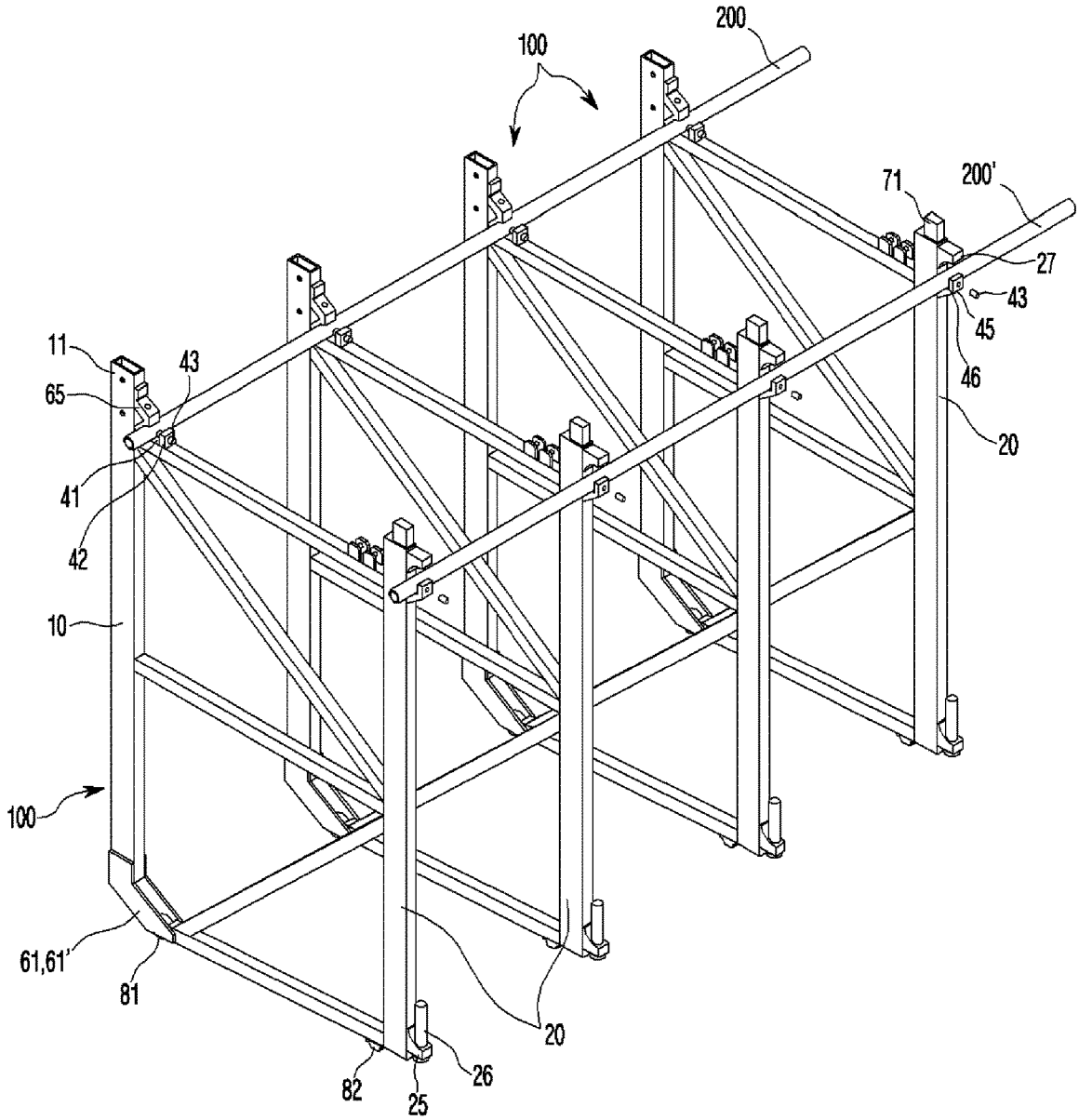
FIG. 6 is a perspective view showing a parallel connection of support frames of the apparatus according to the present disclosure.
Figure 7:
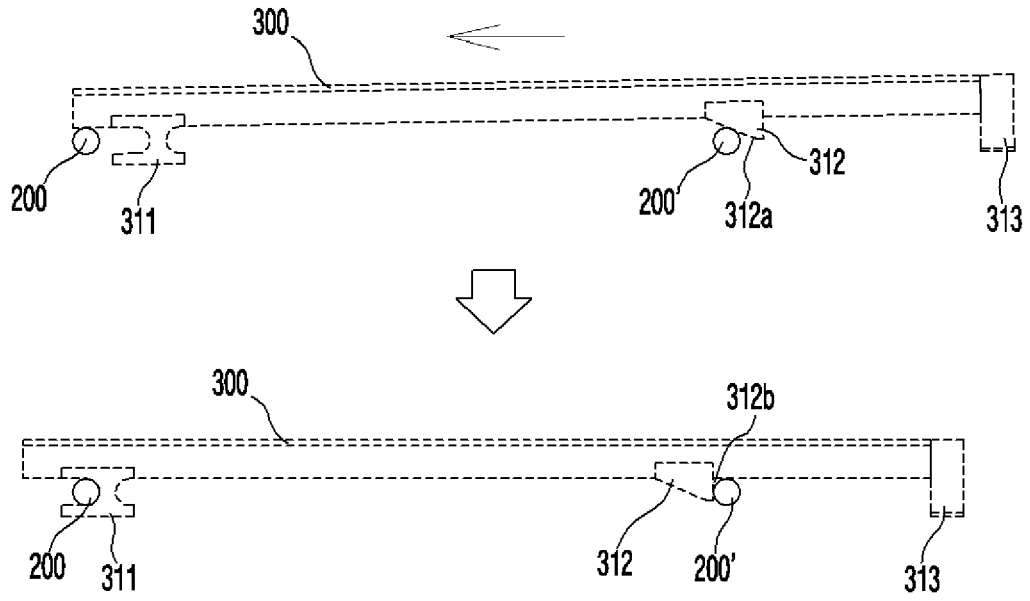
FIG. 7 is a side view showing installing operation of a step according to the present disclosure.
Figure 8:
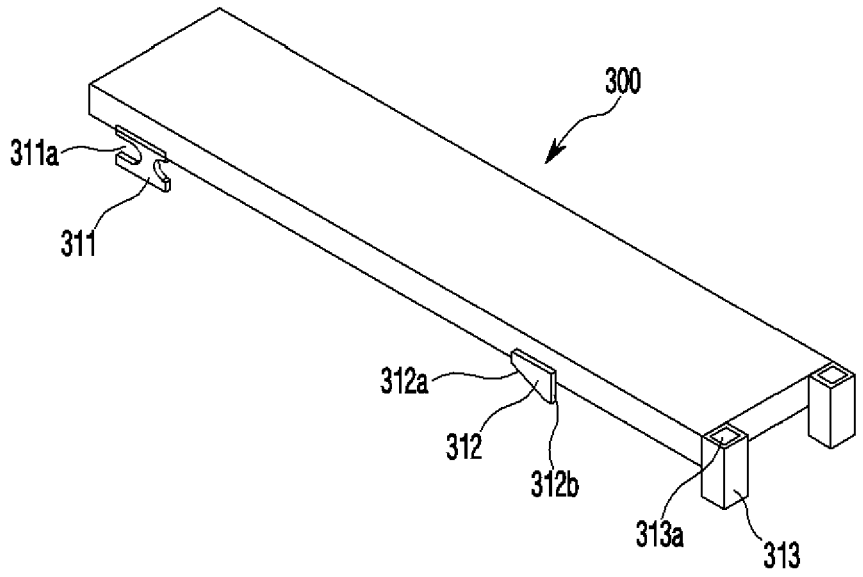
FIG. 8 is a perspective view showing the step according to the present disclosure.

Hereinbelow, exemplary embodiments of the present disclosure will be described in detail with reference to accompanying drawings.

As shown in FIGS. 1 to 12, when a plurality of formworks are continuously installed upward by the height of a formwork 2 for casting concrete structures, i.e., the floor height of a concrete structure or a multi-layer structure, a stack-assembly-type apparatus for supporting a formwork of the present disclosure is not re-installed corresponding to the height of the formwork 2, and is configured to be continuously stacked upward to support the formwork.

The formwork supporting apparatus according to the present disclosure includes a support frame 100, front and rear pipe fixing parts 40 and 50, and front and rear vertical assembling parts 60 and 70.

The support frame 100 is configured such that a front vertical frame 10 positioned at a rear surface of the formwork 2 and a rear vertical frame 20 positioned at a rear of the front vertical frame 10 are connected to each other by a connection frame 30 to be formed in a square form. At least one support frame 100 is installed in parallel left and right directions.

The support frame 100 includes a horizontal bar 3. The horizontal bar 3 is configured to be connected to the front of the front vertical frame 10 in front and right directions, and to be supportably installed to the rear surface of the formwork 2 or to be fixed by a wire, a fixing member, etc.

The front and rear vertical assembling parts 60 and 70 are configured to allow support frames 100 to be assembled with each other while being stacked upward.

A connection part 11 extending above an upper end of the rear vertical frame 20 is formed on an upper portion of the front vertical frame 10, left and right brackets 61 and 61' formed by extending in the left and right directions at a lower portion of the front vertical frame 10, and an insertion groove 62 is formed between the left and right brackets. As the connection part 11 provided at the upper portion of the front vertical frame 10 is inserted into the insertion groove 62 of another front vertical frame 10, vertical assembly is performed for seating the lower portion of the front vertical frame 10. The rear vertical assembling part 70 has an insertion protrusion 71 at an upper portion of the rear vertical frame 20. Therefore, the insertion protrusion 71 is inserted into an inner insertion hole 21 positioned in a lower portion of the rear vertical frame 20 and the vertical assembly is performed as insertion protrusion 71 is inserted into the inner insertion hole 21.

The left and right brackets 61 and 61' are connected to the front of the connection frame 30-1 at inclination by an inclination part 61*a*. An assembly part 65, which has an inclination surface corresponding to the inclination part 61*a* and a coupling hole 66 formed on the inclination surface in a perpendicular direction, is securely installed on the upper portion of the front vertical frame 10 and is inserted between the left and right brackets of another front vertical frame 10. As a fastening screw rod 67 in which a support washer 67*a* is blocked to upper ends of the left and right brackets 61 and 61' is screw-coupled to the coupling hole 66, the front vertical assembling part 60 is fixed vertically.

The front and rear pipe fixing parts 40 and 50 are configured to connect each support frame 100 to front and rear connection pipes 200 and 200' installed in the front and rear of the support frame 100 in the left and right directions.

The front pipe fixing part 40 has a pipe insertion groove 41 formed between the upper portion of the front vertical frame 10 and an upper connection frame 30-2, and the front connection pipe 200 is inserted into the pipe insertion groove 41. A fore end of a clamping bolt 43 that is screw-coupled to a screw hole 42*a* of a first fixing means 42 in rear of the pipe insertion groove 41 fixes the front connection pipe 200 by applying pressure thereto. The rear pipe fixing part 50 has a second fixing means 45 with a pipe insertion groove 46 formed to be open upward is securely installed on a rear surface of the upper portion of the rear vertical frame 20, and the rear connection pipe 200' is inserted into the pipe insertion groove 46. A fore end of the clamping bolt 43 screw-coupled to a screw hole 45*a* in the rear of the second fixing means 45 fixes the rear connection pipe 200' by applying pressure thereto.

In addition, a height adjustment means 25 having a screw hole 25*a* is securely installed on a rear surface of the lower portion of the rear vertical frame, and a height adjustment bar 26 with a lower support plate 26*a* is vertically screw-coupled from the bottom into the screw hole 25*a*, and, a support means 27 with a upper support surface 27*a* is securely installed on the rear surface of the upper portion of the rear vertical frame 20 so that the height adjustment bar 26 is seated and supported on an upper portion of the upper support surface 27*a*.

First and second moving rollers 81 and 82 are provided in the front and the rear of a lower portion of the support frame 100. The first moving roller 81 has a cylindrical shape to roll forward and rearward and the second moving roller 82 has a ball shape to roll in all directions.

Furthermore, a step 300 on which an operator can move is installed by being seated on upper portions of the front and rear connection pipes 200 and 200'. A front support means 311 having a semi-circular insertion groove 311*a* is installed in a lower portion in the front of the step 300 so that the front connection pipe 200 is inserted into the semi-circular insertion groove 311*a*. A rear support means 312 having an inclination surface 312*a* guiding insertion of the rear connection pipe and having a vertical surface 312*b* supporting to prevent separation of the rear connection pipe is installed in a lower portion of the step 300.

In addition, an installation means 313 having an insertion hole 313*a* open upward is securely installed in a rear end of the step 300, and a safety bar 315 to allow the operator to safely move is installed by being inserted into the insertion hole 313*a*.

Furthermore, a lower portion of the vertical extension bar 15 is installed by being inserted into the upper portion of the front vertical frame 10, and the vertical extension bar 15 and the front vertical frame 10 are fixed to each other while adjusting the height of the vertical extension bar 15 and inserting a fastening member into a fixing hole. A support 5 is configured to be connected to and support the vertical extension bar 15 and a connection bracket 35 provided in the rear of the upper connection frame 30-2 by both ends thereof, and is configured to adjust its length.

A non-described reference numeral 90 is a ladder.

Hereinafter, operation and action of the formwork supporting apparatus having the above configuration according to the present disclosure will be described.

In the formwork supporting apparatus according to the present disclosure, at least one support frame 100 formed by connecting the front vertical frame 10 to the rear vertical frame 20 in the square form by the connection frame 30 is installed in parallel. The formwork supporting apparatus is used to support the rear surface of the formwork 2 by connecting the support frame 100 to another support frame 100 by the front and rear connection pipes 200 and 200'.

The front connection pipe 200 is fixed by the front pipe fixing part 40. In detail, the front connection pipe 200 is inserted into the pipe insertion groove 41 positioned between the assembly part 65 of the front vertical frame 10 and the upper connection frame 30-2, and then the clamping bolt 43 screw-coupled to the screw hole 42*a* of the first fixing means 42 is tightened to fix the front connection pipe 200 by applying pressure thereto.

Furthermore, the rear connection pipe 200 is fixed by the rear pipe fixing part 50. In detail, the rear connection pipe 200' is inserted into the pipe insertion groove 46 of the second fixing means 45 installed in the rear surface of the upper portion of the rear vertical frame 20, and then the clamping bolt 43 screw-coupled to the screw hole 45*a* in the rear of the second fixing means is tightened to fix the rear connection pipe 200' by applying pressure thereto.

When the front vertical frame 10 of the support frame 100 cannot support all the vertical height of the formwork 2 as shown in FIG. 1, the lower portion of the vertical extension bar 15 is inserted into the upper portion of the front vertical frame 10. In addition, while the vertical height of the front vertical frame 10 is adjusted, the front vertical frame 10 and the vertical extension bar 15 are fixed to each other by the fastening member inserted through the fixing hole. The support 5 is installed to connect and support the vertical extension bar 15 to/and the rear portion of the upper connection frame 30-2, so that the vertical extension bar 15 supports another upper formwork 2.

Figure 9:
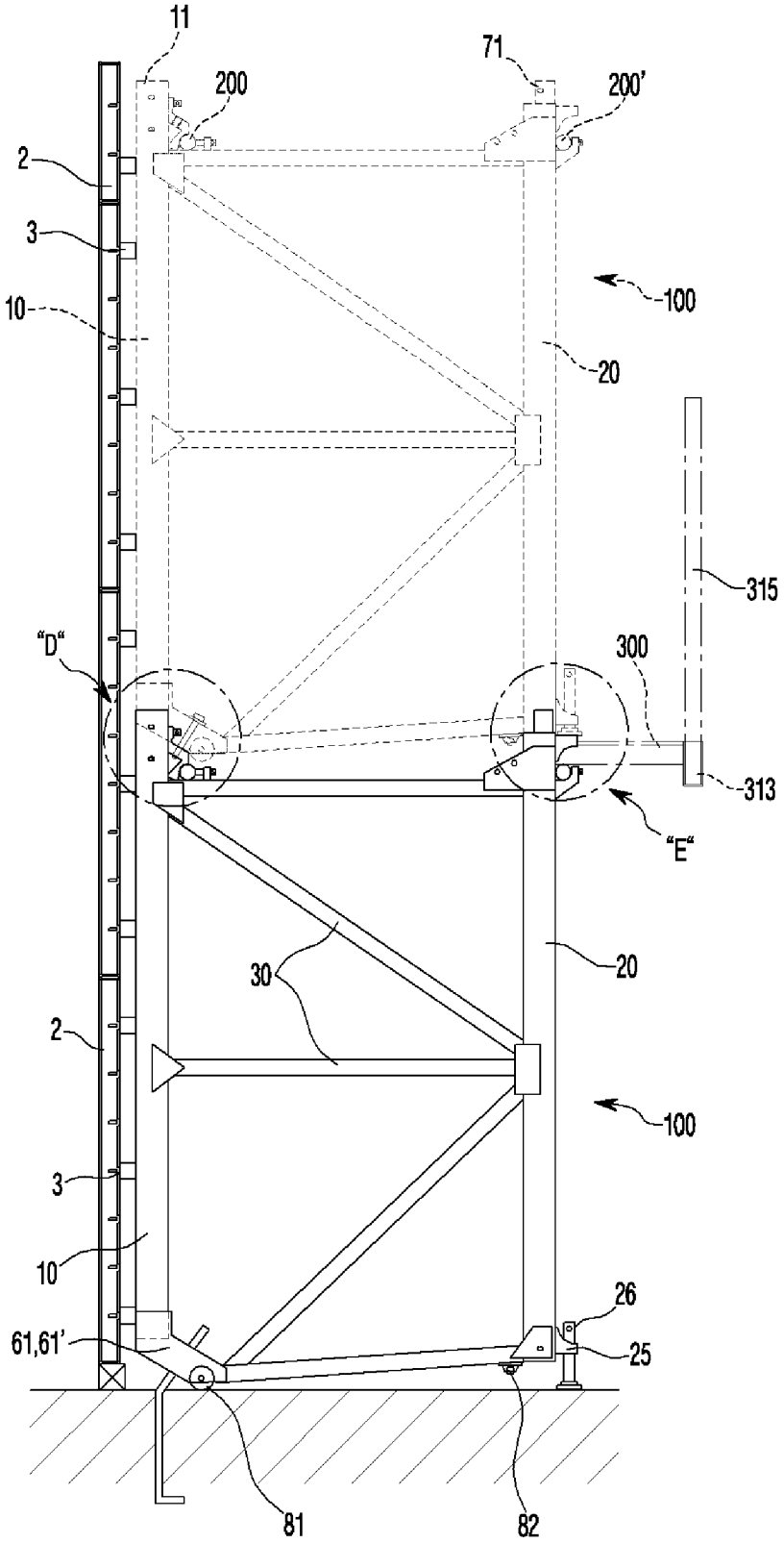
FIG. 9 is a side view showing a stacking installation status of the apparatus according to the present disclosure.
Figure 10:
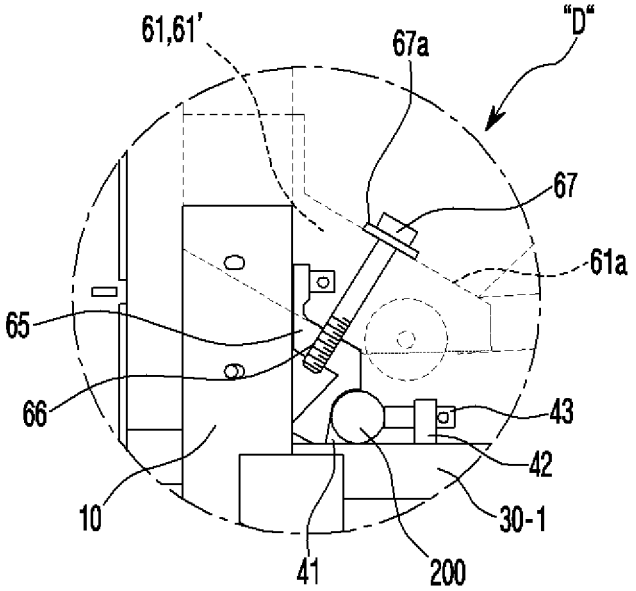
FIGS. 10 and 11 are enlarged views of parts "D" and "E" in FIG. 9.
Figure 11:
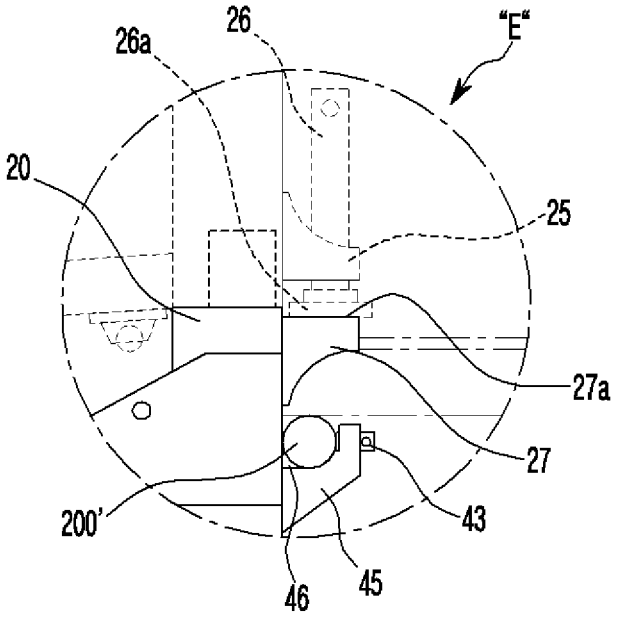
Figure 12:
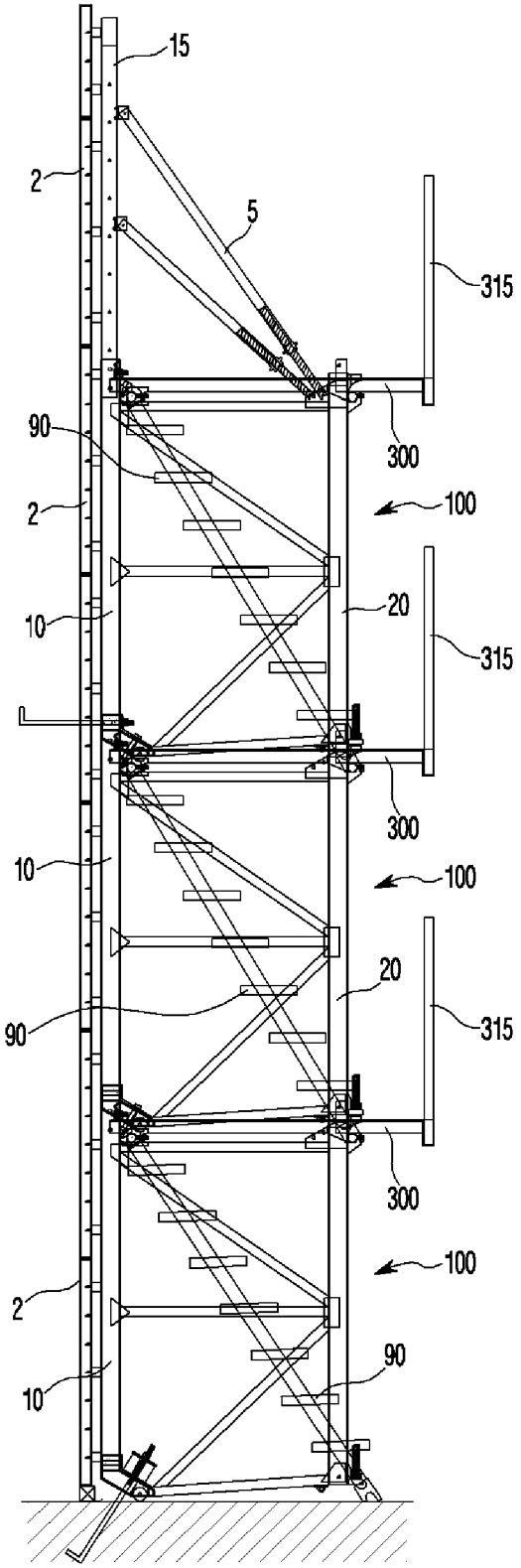
FIG. 12 is a side view showing a multi-layer stacking installation status of the apparatus according to the present disclosure.

When a plurality of formworks is vertically connected to each other corresponding to the floor height of a concrete structure or a multi-layer structure, instead of a conventional method of separating a support device from the formwork and installing a supporting structure and then re-installing another formwork to an upper portion of the supporting structure, the formwork supporting apparatus of this disclosure is vertically stacked to support the formwork, as shown in FIGS. 9 and 12.

The support frame 100 of the present disclosure is formed in the square form. In addition, the upper and lower ends of the front vertical frame 10 and the rear vertical frame 20 are vertically stacked each other and are fixed by the front and rear vertical assembling parts 60 and 70.

In more detail, the rear vertical frame 20 of the support frame 100 is vertically assembled by inserting the insertion protrusion 71 provided at the upper portion of the rear vertical frame 20 into the inner insertion hole 21 provided at the lower portion of another rear vertical frame 20.

Furthermore, the front vertical frame 10 of the support frame 100 is vertically assembled by inserting the connection part 11 provided at the upper portion of the front vertical frame 10 into the insertion groove 62 between the left and right brackets 61 and 61' fixed to the lower portion of another front vertical frame 10.

A screw rod 67 is inserted into the left and right brackets 61 and 61' of the front vertical frame 10. The screw rod 67 is inserted into the left and right brackets 61 and 61' until a support washer 67*a* coupled to the screw rod 67 is blocked by an upper portion of the inclination part 61*a* of the left and right brackets. Then the screw rod 67 is securely screw-coupled to the coupling hole 66 of the assembly part 65.

The height adjustment bar 26 screw-coupled to the screw hole 25*a* of the height adjustment means 25 installed on the rear surface of the lower portion of the rear vertical frame 20 is adjusted in height. Whereby, the lower support plate 26*a* of the height adjustment bar 26 is seated on the upper support surface 27*a* of the support means 27 installed at the rear surface of the upper portion of the rear vertical frame 20, thereby stably supporting the rear vertical frame 20.

As described above, as the support frame 100 is stacked upward in response to the vertical height of the formwork 2 to support the formwork, concrete pouring and curing work is continuously performed without separating the formwork supporting apparatus.

The present disclosure may include the ladder 90, which enables the operator to climb up and down the step 300 and the formwork supporting apparatus, for the formwork supporting apparatus of each floor.

The step 300 is tilted in front and rear directions, and the front connection pipe 200 is inserted into the insertion groove 311*a* of the support means 311 in the front of the step.

The inclination surface 312*a* of the rear support means 312 of the step guides the rear connection pipe 200' while sliding on an upper portion of the rear connection pipe 200'. Then, the rear connection pipe 200' is inserted into the inside of the vertical surface 312*b* and locked thereto. When the load generated by a person standing on the step 300 should be applied to a rear upper portion of the step, the step is locked between the front and rear of the front and rear connection pipes 200 and 200'. Accordingly stable installation may be maintained without movement.

A safety bar 315 is installed by being vertically inserted into the insertion hole 313*a* of the installation means 313 installed at a rear end of the step, so that the operator can move safely.

In addition, the supporting apparatus of the present disclosure may be easily moved by installing the first and second moving rollers 81 and 82 at the lower portion of the support frame 100. The first moving roller 81 has the cylindrical shape to roll forward and rearward, and the second moving roller 82 has the ball shape to roll in all directions. Accordingly, the operator can move the formwork supporting apparatus while easily adjusting the direction.

The invention claimed is:

1. A stack-assembly-type apparatus for supporting a formwork, the stack-assembly-type apparatus comprising:

a support frame (100) comprising a front vertical frame (10) positioned at a rear surface of a formwork (2), a rear vertical frame (20) positioned at rear of the front vertical frame, and a connection frame (30) connecting the front vertical frame (10) to the rear vertical frame (20) in a square form;

front and rear pipe fixing parts (40 and 50) configured to couple and assemble at least one support frame (100) provided in parallel in left and right directions to front and rear connection pipes (200 and 200') provided in left and right directions at front and rear portions of the support frame (100); and front and rear vertical assembling parts (60 and 70) configured to connect and assemble the support frame (100) to another support frame (100) by vertically stacking the support frames (100), wherein, in the front vertical assembling part (60), a connection part (11) is located on an upper portion of the front vertical frame (10) and extends upward higher than an upper end of the rear vertical frame (20), and left and right brackets (61 and 61') configured to be connected to a lower connection frame (30-1) and extend in the left and right directions, and the left and right brackets (61 and 61') of the front vertical assembling part (60) are configured to be inclined and connected to each other by both the lower connection frame (30-1) and an inclination part (61*a*), an assembly part (65) comprising an inclination surface corresponding to the inclination part (61*a*) of each of the left and right brackets (61 and 61') and a coupling hole (66) located perpendicularly to the inclination surface is securely provided on the upper portion of the front vertical frame (10) and is inserted between the left and right brackets, and a fastening screw rod (67) that is supported such that an upper end thereof is blocked to upper ends of the left and right brackets (61 and 61') by a support washer (67*a*) and is screw-coupled to the coupling hole (66), so that the front vertical assembling part (60) is vertically fixed, and wherein the front pipe fixing part (40) has a pipe insertion groove (41) at a position between the upper portion of the front vertical frame (10) and an upper connection frame (30-2), and the front connection pipe (200) is inserted into the pipe insertion groove (41), the pipe insertion groove (41) being configured such that a fore end of a clamping bolt (43) that is screw-coupled to a screw hole (42*a*) of a first fixing means (42) in the rear of the pipe insertion groove (41) fixes the front connection pipe (200) by applying pressure thereto, and the rear pipe fixing part (50) is configured such that, a second fixing means (45) in which a pipe insertion groove (46) is formed to be open upward is securely provided on a rear surface of an upper portion of the rear vertical frame (20), and the rear connection pipe (200') is inserted into the pipe insertion groove (46), and a fore end of the clamping bolt (43) that is screw-coupled to a screw hole (45*a*) located at the rear of the pipe insertion groove (46) fixes the rear connection pipe (200') by applying pressure thereto.

2. The stack-assembly-type apparatus of claim 1, wherein the front vertical assembling part (60) is configured such that the connection part (11) located at the upper portion of the front vertical frame (10) is inserted into an insertion groove (62) located between the left and right brackets (61 and 61') in the lower portion of another front vertical frame (10), so that vertical assembly of the front vertical frame (10) is achieved, and the rear vertical assembling part (70) is configured such that an insertion protrusion (71) formed by protruding from an upper portion of the rear vertical frame (20) is inserted into an inner insertion hole (21) located at a lower portion of another rear vertical frame (20), so that vertical assembly of the rear vertical frame (20) is achieved.

3. The stack-assembly-type apparatus of claim 1, wherein first and second moving rollers (81 and 82) are provided in a front portion and a rear portion of a lower portion of the support frame (100), wherein the first moving roller (81) has a cylindrical shape to roll forward and rearward and the second moving roller (82) has a ball shape to roll in all directions.

4. The stack-assembly-type apparatus of claim 1, wherein the rear vertical frame (20) comprises a height adjustment means (25), a height adjustment bar (26), and a support means (27), wherein the height adjustment means (25) has a screw hole (25*a*) and is securely provided on a rear surface of the lower portion of the rear vertical frame (20), the height adjustment bar (26) in which a lower support plate (26*a*) is connected to a lower portion thereof is vertically screw-coupled to the screw hole (25*a*) by being inserted from a lower portion of the screw hole (25*a*), and the support means (27) has an upper support surface (27*a*) and is securely provided on a rear surface of an upper portion of the rear vertical frame (20) to support seating of the height adjustment bar (26) of another support frame.

5. A stack-assembly-type apparatus for supporting a formwork, the stack-assembly-type apparatus comprising:

a support frame (100) comprising a front vertical frame (10) positioned at a rear surface of a formwork (2), a rear vertical frame (20) positioned at rear of the front vertical frame, and a connection frame (30) connecting the front vertical frame (10) to the rear vertical frame (20) in a square form;

front and rear pipe fixing parts (40 and 50) configured to couple and assemble at least one support frame (100) provided in parallel in left and right directions to front and rear connection pipes (200 and 200') provided in left and right directions at front and rear portions of the support frame (100); and front and rear vertical assembling parts (60 and 70) configured to connect and assemble the support frame (100) to another support frame (100) by vertically stacking the support frames (100), wherein, in the front vertical assembling part (60), a connection part (11) is located on an upper portion of the front vertical frame (10) and extends upward higher than an upper end of the rear vertical frame (20), and left and right brackets (61 and 61') configured to be connected to a lower connection frame (30-1) and extend in the left and right directions, and the left and right brackets (61 and 61') of the front vertical assembling part (60) are configured to be inclined and connected to each other by both the lower connection frame (30-1) and an inclination part (61*a*), an assembly part (65) comprising an inclination surface corresponding to the inclination part (61*a*) of each of the left and right brackets (61 and 61') and a coupling hole (66) located perpendicularly to the inclination surface is securely provided on the upper portion of the front vertical frame (10) and is inserted between the left and right brackets, and a fastening screw rod (67) that is supported such that an upper end thereof is blocked to upper ends of the left and right brackets (61 and 61') by a support washer (67*a*) and is screw-coupled to the coupling hole (66), so that the front vertical assembling part (60) is vertically fixed, and wherein a step (300), on which an operator moves, is provided at upper portions of the front and rear connection pipes (200 and 200'), the step (300) comprising: a front support means (311) having a semi-circular insertion groove (311*a*) and being provided in a lower portion of a front portion of the step (300) so that the front connection pipe (200) is inserted into the semi-circular insertion groove (311*a*); and a rear support means (312) provided in a rear portion of the step (300) and having both an inclination surface (312*a*) configured to guide insertion of the rear connection pipe (200') and a vertical surface (312*b*) configured to support the rear connection pipe to be prevented from separation.

* * * * *